US008269621B2

(12) United States Patent
Shapira et al.

(10) Patent No.: US 8,269,621 B2
(45) Date of Patent: Sep. 18, 2012

(54) MEZUZAH CASE

(76) Inventors: Tomer Shapira, Kfar Neter (IL); Eli Levi, Ra'anana (IL)

( * ) Notice: Subject to any disclaimer, the term of this patent is extended or adjusted under 35 U.S.C. 154(b) by 316 days.

(21) Appl. No.: 12/577,192

(22) Filed: Oct. 11, 2009

(65) Prior Publication Data

US 2011/0084829 A1 Apr. 14, 2011

(51) Int. Cl.
*G08B 23/00* (2006.01)

(52) U.S. Cl. ..... 340/517; 340/506; 340/13.31; 340/328; 340/330; 340/539.1

(58) Field of Classification Search ..... 340/506, 340/13.31, 328, 330, 531, 539.1
See application file for complete search history.

(56) References Cited

U.S. PATENT DOCUMENTS

| | | | | |
|---|---|---|---|---|
| 6,114,948 | A * | 9/2000 | Astell | 340/332 |
| 6,897,765 | B2 * | 5/2005 | Kaje | 340/321 |
| 7,015,943 | B2 * | 3/2006 | Chiang | 348/143 |
| 7,746,223 | B2 * | 6/2010 | Howarter et al. | 340/506 |
| 2006/0139449 | A1 * | 6/2006 | Cheng et al. | 348/61 |
| 2008/0129498 | A1 * | 6/2008 | Howarter et al. | 340/541 |
| 2008/0129821 | A1 * | 6/2008 | Howarter et al. | 348/143 |
| 2010/0044248 | A1 * | 2/2010 | Koby et al. | 206/19 |

* cited by examiner

*Primary Examiner* — Daryl Pope
(74) *Attorney, Agent, or Firm* — Deborah Gador

(57) ABSTRACT

The present invention relates to a mezuzah case having an electronic signaling device for attracting attention of Jewish people walking through a doorway to a mezuzah which is affixed to the doorpost. The Mezuzah case includes housing for holding and protecting a mezuzah parchment and an electric signaling device for emitting a noticeable signal. According to one embodiment the signaling device is a light source. According to an alternative embodiment, the signaling device emits an audio signal. The mezuzah case may further include electronic means for automatically controlling the signaling device according to a preset program and a power source for energizing the electronic means and the signaling device.

17 Claims, 6 Drawing Sheets

MEZUZAH CASE

FIELD OF THE INVENTION

The present invention relates to a ritual article case, in general and, in particular, to a mezuzah parchment case.

BACKGROUND OF THE INVENTION

A mezuzah is an article of a Jewish religious ritual which includes a parchment inscribed with specified biblical verses in Hebrew. A biblical commandment requires that a mezuzah is affixed to a doorpost of each doorway in each room in Jewish homes, offices, etc. The commandment of the mezuzah is accepted not only by observant Jews, but also by most other Jews who believe that the mezuzah provides divine protection. The mezuzah parchment is rolled up and placed inside a mezuzah case. The mezuzah case includes housing for holding the parchment and a base for affixing the housing to the doorpost.

It has become customary among traditional Jews to touch the mezuzah with their hand upon leaving or entering the house or room to express awareness of the fulfillment of the commandment, and to show reliance upon God's protection. However, at times, people become forgetful of the presence of the mezuzah and tend to cross the doorway without touching it. In addition, it is difficult to locate a mezuzah in the dark for touching it.

Accordingly, there is a long felt need for a mezuzah having a signaling device which attracts the attention of a Jewish person crossing the doorway, and it would be very desirable to have a mezuzah with a signaling device, which permits to readily locate it.

SUMMARY OF THE INVENTION

There is provided according to the present invention a mezuzah case for affixing on a doorpost. The mezuzah case includes a housing configured for holding a mezuzah parchment, and a signaling device mounted to the housing. The signaling device is adapted and configured to emit a signal for attracting the attention of people walking through the doorway. According to one embodiment, the mezuzah further includes a power source coupled to the signaling device.

Preferably, the mezuzah case further includes electronic means for automatically controlling the signaling device according to a preset program.

According to one embodiment, the mezuzah case further includes a battery housing having at least one clip for holding the parchment housing. Preferably, the battery housing includes a removable housing.

The mezuzah case further includes a push-button switch which is adapted for actuating the signaling device. The push-button switch is further adapted for presetting the signaling device. According to one embodiment the push-button switch includes a keyboard.

According to one embodiment of the invention, the signaling device includes a light source of at least one color, which is preferably an LED According to another embodiment of the invention, the signaling device is an audio source adapted to generate an audio signal.

Preferably, the signaling device includes a circuit board having according to one embodiment, a peripheral interface controller (PIC) adapted for controlling the signaling device. Preferably, the PIC is further adapted for controlling the on/off switching of the signaling device. In addition, the PIC may further include a timer for determining the day and the time of the day and duration of operation of the signaling device.

According to yet another embodiment of the invention, the mezuzah case further includes a sensor for actuating the signaling device. The sensor is selected from the group including a sensor adapted for sensing a person walking through the doorway, a sensor adapted for sensing the touching of the mezuzah case by a person, and a sensor adapted for sensing when light intensity drops below a threshold value.

According to one embodiment of the invention, the housing of the mezuzah case is transparent.

There is further provided according to the present invention a method for forming a mezuzah case for affixing on a doorpost. The method includes: providing a housing configured for holding a mezuzah parchment, providing a signaling device adapted and configured to emit a signal for attracting the attention of people walking through the doorway, and, mounting the signaling device to the housing.

Preferably, the method for mezuzah case further includes the step of coupling the signaling device to a power source.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to a mezuzah case having an electronic signaling device for attracting attention of Jewish people walking through a doorway to a mezuzah which is affixed to the doorpost. The mezuzah case includes housing for holding and protecting a mezuzah parchment and an electric signaling device for emitting a noticeable signal. According to one embodiment the signaling device is a light source permanently or periodically illuminating, or alternatively blinking. According to an alternative embodiment, the signaling device emits an audio signal, such as a tune, ring or a short announcement. The mezuzah case may further include electronic means for automatically controlling the signaling device according to a preset program and a power source for energizing the electronic means and the signaling device.

Figure 1:
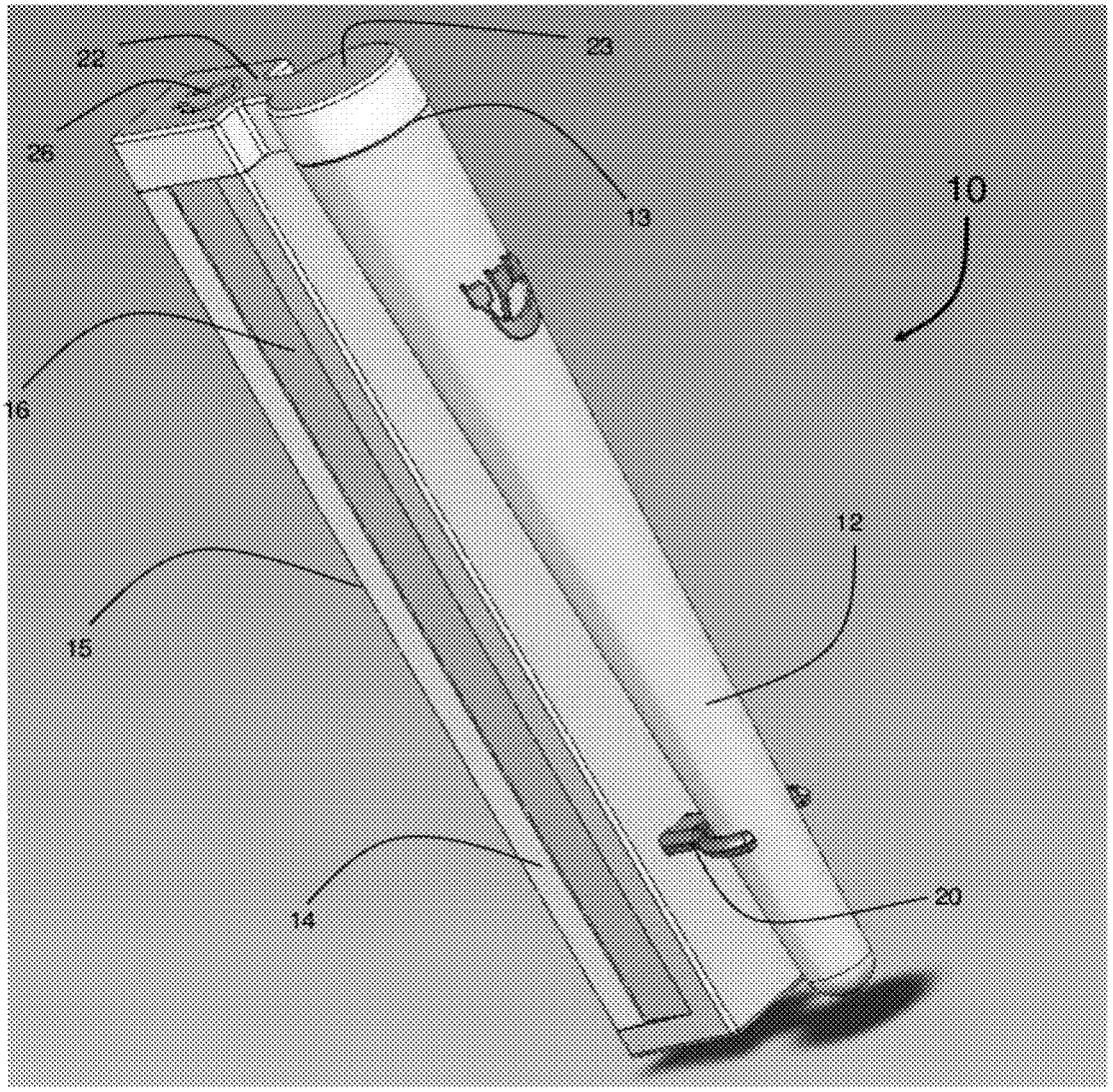
FIG. 1 is a side perspective view illustration of a mezuzah case constructed and operative in accordance with one embodiment of the present invention.
Figure 2:
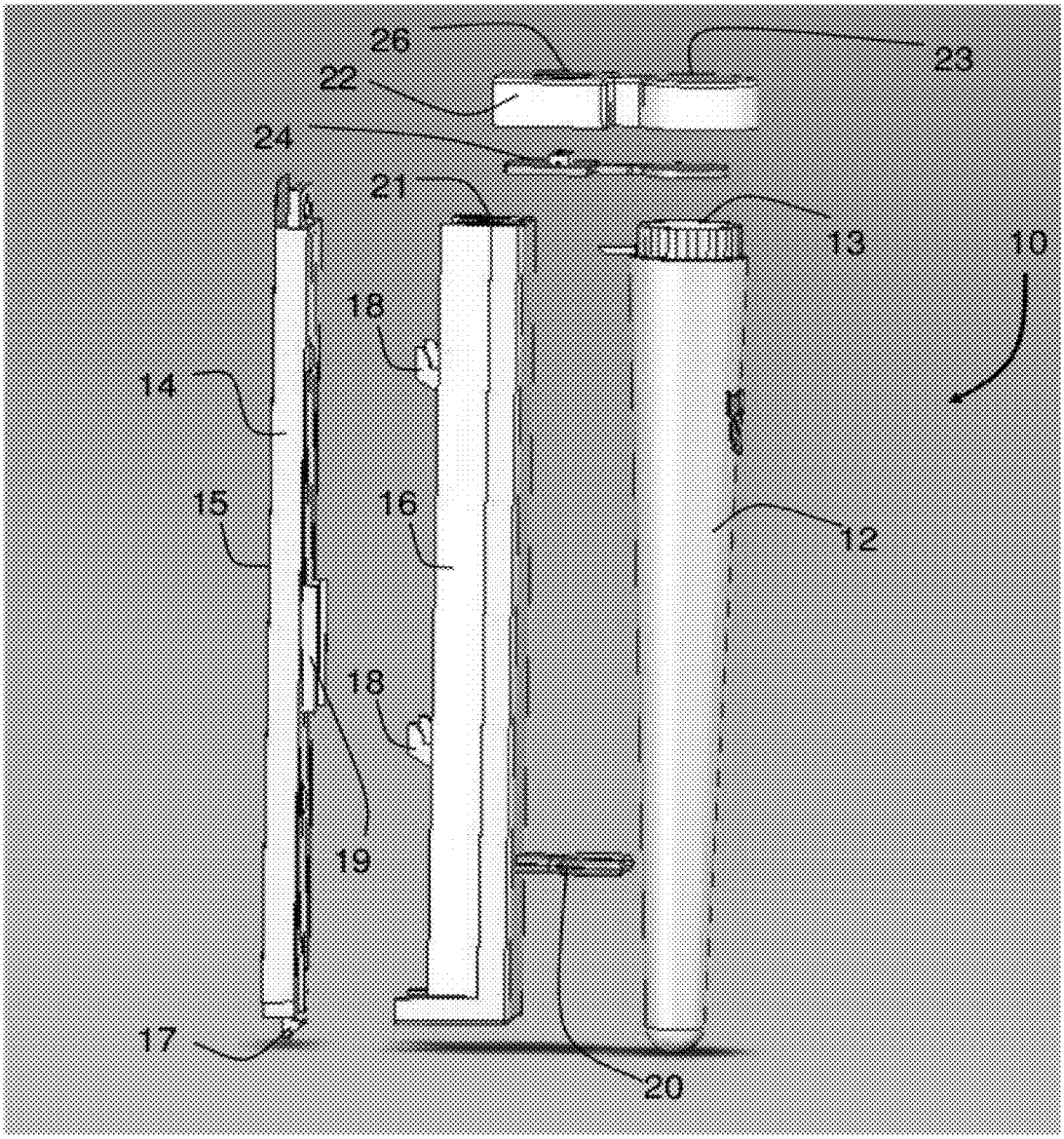
FIG. 2 is a side exploded illustration of the Mezuzah case of FIG. 1.

FIGS. 1 and 2 are a side perspective view, and a side exploded view, respectively, of mezuzah case 10 constructed and operative in accordance with one embodiment of the invention. Mezuzah case 10 includes a parchment housing 12 for holding a mezuzah parchment scroll. Parchment housing 12 according to one embodiment includes an upper opening 13. Mezuzah case 10 further includes a base 14 having a mountable side 15 for mounting the case on a doorpost. Mezuzah case 10 further includes a battery housing 16 having at least one clip 20 for holding parchment housing 12. Battery housing 16 further includes hooks 18 for mounting in complementary grooves (not shown) on base 14. Base 14 further includes a locking tongue 17 for fastening battery housing 16, and a guiding track 19.

Mezuzah case 10 further includes a signaling device 22 mounted on the end portion of base 14. According to this embodiment, signaling device 22 includes a cover portion 23 configured to cover opening 13 on parchment housing 12. Signaling device 22 includes an electric circuit board 24, and a push-button switch 26 for actuating signaling device 22. Circuit board 24 is electrically coupled to the batteries inside battery housing 16 via a terminal 21, mounted on top of battery housing 16.

According to one embodiment signaling device 22 includes a light source (not shown), such as an LED coupled to circuit board 24. The light source is mounted in such a way, so as to attract the attention of people walking through the doorway on which the mezuzah case is affixed. According to a preferred embodiment the light source is positioned inside parchment housing 12, which may be transparent in full or in part, or translucent. Alternatively, the light source may be positioned elsewhere in close proximity to the mezuzah case, for example, on top of cover portion 23. According to a preferred embodiment signaling device 22 can be preset by the user to operate in a desired mode, for example by pressing on push-button switch 26. Presetting signaling device 22 may include selecting the desired signal by pressing the push-button switch 26. For example the selection can be of the color of the light source, in the event that the signaling device 22 includes light sources of more than one color and is arranged to switch between them.

Mezuzah case 10 can be mounted on a doorpost by mounting base 14 to the side panel of the doorpost. Mountable side 15 of base 14 may include mounting elements, such as Velcro, adhesive layer, or apertures for inserting screws. Alternatively, a layer of adhesive material may be applied to the mountable side 15.

Figure 3:
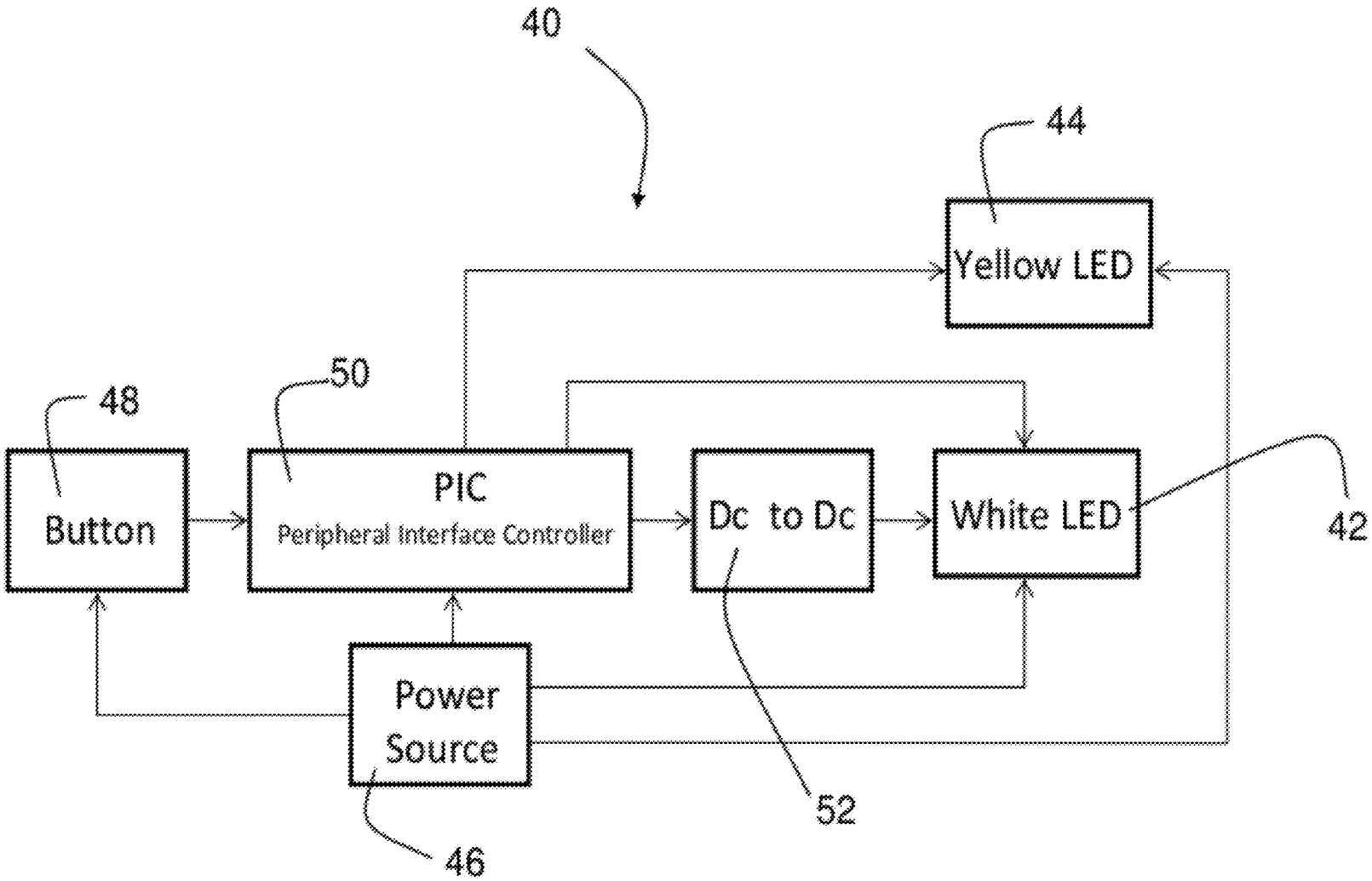
FIG. 3 is a schematic block diagram illustration of a signaling device constructed and operative in accordance with one embodiment of the present invention.

FIG. 3 is a block diagram illustrating the components of a signaling device 40 constructed and operative in accordance with one embodiment of the invention. Signaling device 40 is adapted to generate a visual signal and includes a white LED 42 and a Yellow LED 44. White LED 42 and Yellow LED 44 are electrically coupled to a power source 46. Power source 46 is further coupled to a push-button switch 48 which may be utilized to actuate and preset signaling device 40. In addition, power source 46 is coupled to a peripheral interface controller (hereinafter PIC) 50, which electrically controls the on/off switching of white LED 42 and Yellow LED 44. Preferably, PIC 50 controls the operation of signaling device 40, and determines the frequency of the on/off switching of LEDs 42 and 44. According to one embodiment PIC 50 includes a plurality of preset programs of on/off switching frequencies of the LEDs, such as the set of blinks of white LED 42 followed by a set of blinks by the yellow LED 44. In addition, PIC 50 may further include a timer for determining the day and/or the time of the day and/or duration of operation of signaling device 40. Since white LED 42 requires relatively high voltage, a DC to DC step up 52 is preferably provided. In the event that power source 46 fails to provide the voltage necessary for the operation of white LED 42, DC to DC step up 52 increases the voltage, thus, allowing white LED 42 to illuminate. It will be appreciated, that other means known in the art may be applied to ensure the proper operation of LEDs 42 and 44.

Actuation of signaling device 40 is carried out by pressing push-button switch 48. According to one embodiment, presetting a desired on/off switching frequency and the timer can be carried out by pressing push-button switch 48. In order for signaling device 40 to distinguish between actuation presetting by push-button switch 48, PIC 50 may be adapted to recognize, for example the duration of a press or of a sequence of presses of push-button switch 48. It will be appreciated that push-button switch 48 may include a plurality of push-button switches or a keyboard.

According to another embodiment of the invention, the mezuzah case may further include a sensor, which may be adapted to sense a person walking across the doorway on which the mezuzah case is affixed. Upon sensing of a person, the sensor may actuate the signaling device. Alternatively, the mezuzah case may include a sensor which is adapted to actuate the signaling device in response to touching the mezuzah case by a person. The signal emitted by the touching may provide an incentive for one to touch and kiss the mezuzah case. Yet alternatively, the mezuzah case may include a sensor which is adapted to actuate the signaling device when light intensity drops below a threshold value.

According to another embodiment of the invention, the signaling device may include an audio source adapted to generate an audio signal in addition to, or instead of, a visual signal. The audio signal can be a short tune, a ring, or a short announcement such as "God bless you", "good day" etc. It will be appreciated that the volume of the audio signal may be determined in accordance with the background noise, so as to allow one who walks by the mezuzah case to hear the audio signal. It will be further appreciated that the volume of the audio signal may be preset so as not to disturb others in close proximity with the mezuzah case.

Figure 4:
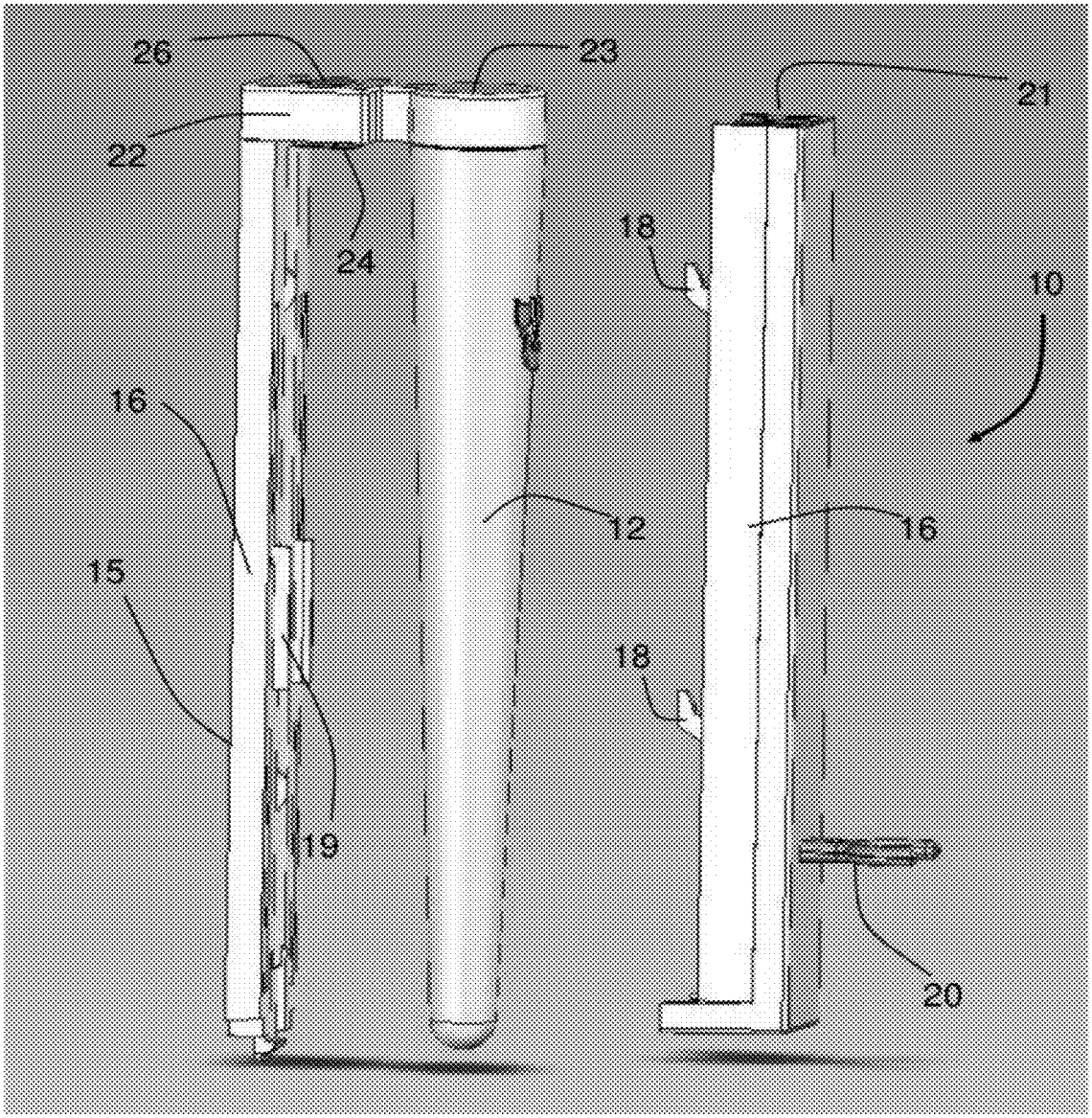
FIG. 4 is a side view of the Mezuzah case of FIG. 1 having its battery housing removed.
Figure 5:
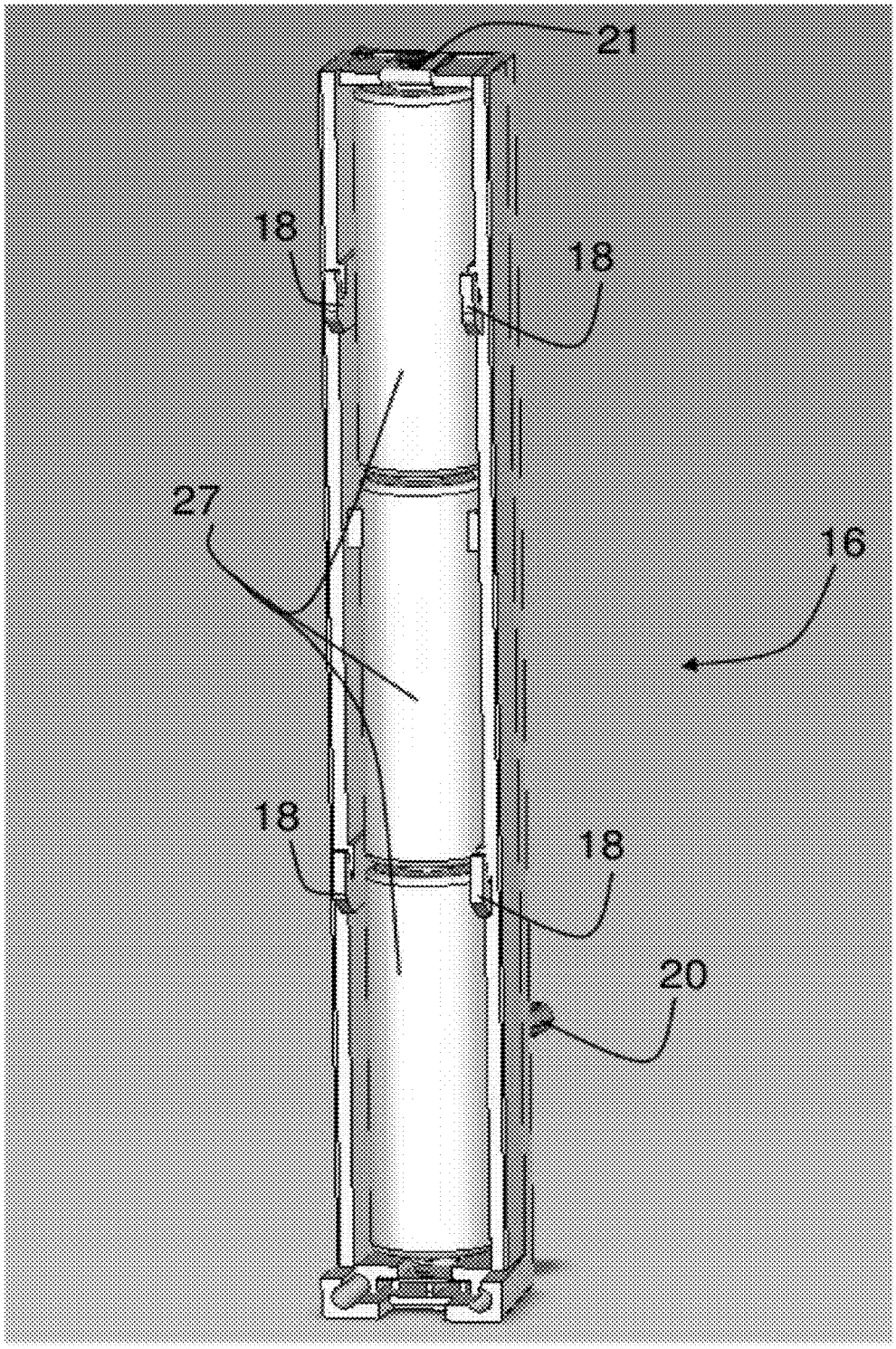
FIG. 5 is a back side view of the battery housing constructed and operative in accordance with one embodiment of the present invention; and, FIG. 6 is a front perspective view of a Mezuzah case constructed and operative in accordance with another embodiment of the invention.

According to a preferred embodiment of the invention the user may replace the batteries inside the battery housing without removing the mezuzah case off the doorpost. FIG. 4 is a side view illustration of the mezuzah case 10 of FIG. 1 wherein its battery housing is removed from base 14. According to this embodiment, while battery housing 16 is removed, parchment housing 12 remains coupled to base 14 by means of the signaling device 22 and cover portion 23. Hooks 18 allow removably mounting battery housing 16 to base 14, to allow a user to easily disassemble battery housing 16 from base 14.

The battery case is configured to hold batteries 27 having size and capacity in accordance with the power required for operating signaling device 22. Housing 16 includes tabs 28 for retaining batteries 27 in place.

Guiding tracks 19 provide for battery housing 16 to slide in parallel to base 14, thus ensuring proper coupling of terminal 21 and circuit board 24 inside signaling device 22. The sliding of battery housing 16 back onto base 14 causes clip 20 to reengage parchment housing 12 thereby maintaining parchment housing 12 aligned with, and fixed to, base 14. Battery housing 16 is moved upwardly until terminal 21 contacts circuit board 24 of signaling device 22. Locking tongue 17 locks battery housing 16 onto base 14.

According to a further embodiment the mezuzah case may be coupled to an external power source, such as a home electric system. According to this embodiment there is no need for battery housing and thus, the parchment housing is mounted directly on the base of the mezuzah case.

Figure 6:
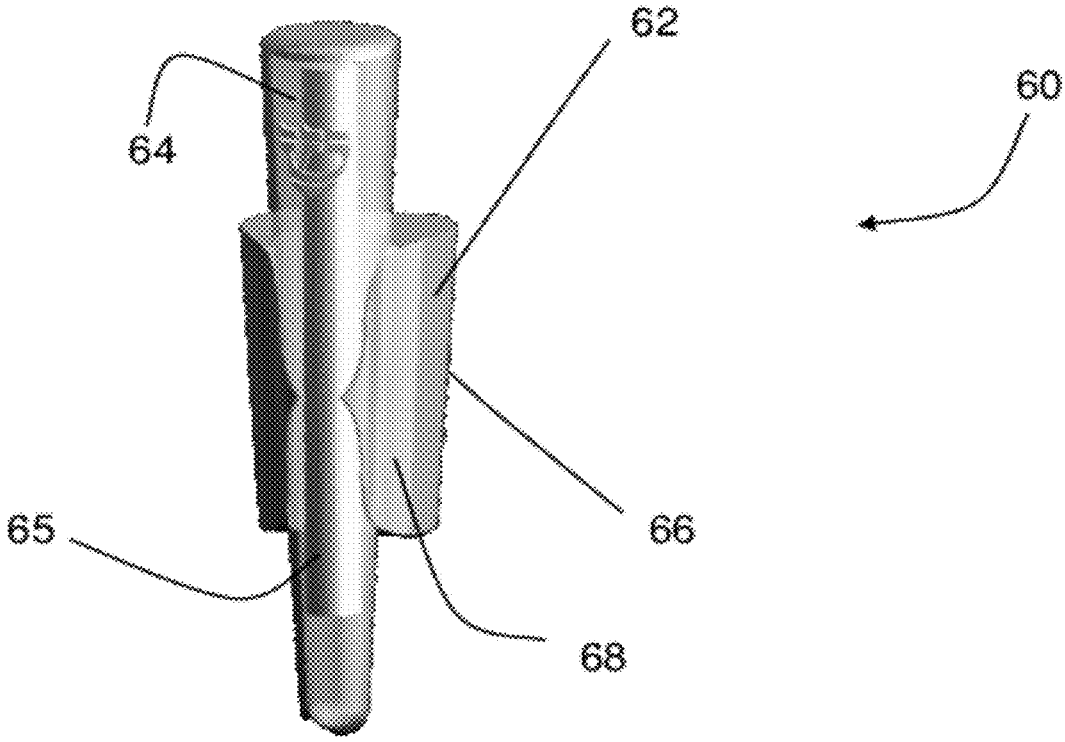

FIG. 6 is a front perspective view illustration of a mezuzah case 60 constructed and operative in accordance with another embodiment of the invention. Mezuzah case 60 includes a base 62 and a parchment tube 64 having a mezuzah parchment 65 disposed therein. Base 62 includes a mountable portion 66 for mounting on a doorpost, and a semi cylindrical portion 68 for holding parchment tube 64.

Parchment tube 64 is a transparent tube designed as a light guide, and includes a light source (not shown), such an LED, mounted therein. According to one embodiment base 62 further includes a power source (not shown) coupled to the light source, alternatively the light source may be connected directly to the house electrical system.

When the light source is turned on, parchment tube 64 is illuminated from within, thereby grasps the attention of people walking through the doorway. Mezuzah case 60 may further include an additional light source having for example a different color. In addition, mezuzah case 60 may include electronic means for controlling the on/off switching of the light source.

According to one embodiment mezuzah case 60 may further include means for reducing the heat generated by the light source mounted inside parchment tube 64 thus, precluding damage to the parchment disposed therein.

While the mezuzah housing of the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. A mezuzah case for affixing on a doorpost, the mezuzah case comprising:

a parchment housing;

a mezuzah parchment disposed in said parchment housing;

an electric signaling device coupled to a power source and emitting a noticeable signal; and a base with mounting means for mounting on a doorpost, wherein said base is coupled to said parchment housing.

2. The mezuzah case of claim 1, further comprising electronic means for automatically controlling said signaling device according to a preset program.

3. The mezuzah case of claim 1, further comprising a battery housing removably coupled to said base and having at least one clip for holding said battery housing to said parchment housing.

4. The mezuzah case of claim 1, further comprising a push-button switch actuatingly coupled to said signaling device.

5. The mezuzah case of claim 4, wherein said push-button switch is further adapted for presetting said signaling device.

6. The mezuzah case of claim 4, wherein said push-button switch comprises a keyboard.

7. The mezuzah case of claim 1, wherein said signaling device comprises a light source of at least one color.

8. The mezuzah case of claim 7, wherein said light source comprises an LED.

9. The mezuzah case of claim 1, wherein said signaling device includes means for generating an audio signal.

10. The mezuzah case of claim 1, wherein said signaling device comprises a peripheral interface controller (PIC) controllingly coupled to said signaling device.

11. The mezuzah case of claim 10, wherein said PIC controls on/off switching of said signaling device.

12. The mezuzah case of claim 10, wherein said PIC comprises a timer for determining the day and the time of the day and duration of operation of said signaling device.

13. The mezuzah case of claim 1, further comprising a sensor for actuating said signaling device, said sensor selected from the group including a sensor adapted for sensing a person walking through the doorway, a sensor adapted for sensing the touching of the mezuzah case by a person, and a sensor adapted for sensing when light intensity drops below a threshold value.

14. The mezuzah case of claim 1, wherein said housing is transparent.

15. A method for forming a mezuzah case for affixing on a doorpost, the method comprising:

providing a parchment housing configured for holding a mezuzah parchment;

disposing a mezuzah parchment in said parchment housing;

mounting an electric signaling device to the mezuzah case emitting a signal for attracting the attention of people walking through the doorway to said housing; and, coupling a base with mounting means for mounting on a doorpost to said parchment housing.

16. The method for forming a mezuzah case of claim 15, further comprising the step of mounting a power source for said signaling device in the case.

17. The mezuzah case according to claim 1, further comprising:

a battery housing having at least one clip for holding said parchment housing to said battery housing;

hooks in said battery housing for mounting in complementary grooves on said base;

wherein said base further includes a locking tongue and a guiding track for fastening said battery housing to said base.

* * * * *